US011448402B2

(12) United States Patent
Proffitt et al.

(10) Patent No.: US 11,448,402 B2
(45) Date of Patent: Sep. 20, 2022

(54) RADIANT ELECTRIC HEATER

(71) Applicant: Ceramaspeed, Inc., Maryville, TN (US)

(72) Inventors: Tyson Proffitt, Vonore, TN (US); Jason Triplett, Friendsville, TN (US); Scottie Russel, Alcoa, TN (US)

(73) Assignee: Eika S. Coop, Etxebarria (ES)

( * ) Notice: Subject to any disclaimer, the term of this patent is extended or adjusted under 35 U.S.C. 154(b) by 662 days.

(21) Appl. No.: 16/462,223

(22) PCT Filed: Dec. 4, 2017

(86) PCT No.: PCT/US2017/064560

§ 371 (c)(1),
(2) Date: May 18, 2019

(87) PCT Pub. No.: WO2018/106614

PCT Pub. Date: Jun. 14, 2018

(65) Prior Publication Data

US 2019/0285282 A1 Sep. 19, 2019

Related U.S. Application Data

(60) Provisional application No. 62/431,401, filed on Dec. 7, 2016.

(51) Int. Cl.

| | |
|---|---|
| ***H05B 3/68*** | (2006.01) |
| ***F24C 7/06*** | (2006.01) |
| ***H05B 3/74*** | (2006.01) |

(52) U.S. Cl.
CPC ..... *F24C 7/067* (2013.01); *H05B 3/748* (2013.01)

(58) Field of Classification Search
CPC .. F24C 7/04; F24C 7/043; F24C 7/046; F24C 7/06; F24C 7/062; F24C 7/067;
(Continued)

(56) References Cited

U.S. PATENT DOCUMENTS

| | | | | |
|---|---|---|---|---|
| 4,845,340 | A | 7/1989 | Goessler et al. | |
| 5,051,561 | A * | 9/1991 | McWilliams ..... | H05B 3/744 219/461.1 |

(Continued)

FOREIGN PATENT DOCUMENTS

| | | |
|---|---|---|
| DE | 9113992 | 1/1992 |
| DE | 9407377 | 7/1994 |
| EP | 1215940 | 6/2002 |

OTHER PUBLICATIONS

PCT Search Report for PCT Application PCT/US2017/064560 dated Feb. 21, 2018.

*Primary Examiner* — Sang Y Paik
(74) *Attorney, Agent, or Firm* — Neil D. Gershon

(57) ABSTRACT

A radiant electric heater having a dish-like support having a base layer of thermal insulation material. At least one heating element is supported relative to the base layer. A temperature-responsive device having a rod-like component is secured at one end at a peripheral region of the dish-like support and extends without support partly across the heater over the at least one heating element. A supporting member is provided at a free end region of the rod-like component. The supporting member comprises a central portion with a hoop at a first end to receive the free end of the rod-like component and a foot at a second end, the foot being bent at an angle relative to the central portion. A base of the dish-like support is provided with a loop of material extending internally of the dish-like support so as to provide an opening between the base of the dish-like support and the loop, the foot of the supporting member being received through the opening.

19 Claims, 3 Drawing Sheets

(58) Field of Classification Search
CPC . H05B 3/68; H05B 3/74; H05B 3/742; H05B 3/744; H05B 3/748; H05B 2203/00
USPC ..... 219/443.1–468.2
See application file for complete search history.

(56) References Cited

U.S. PATENT DOCUMENTS

| | | | | |
|---|---|---|---|---|
| 6,483,084 | B2 * | 11/2002 | Petri | H05B 3/74 219/460.1 |
| 6,603,100 | B2 * | 8/2003 | Wilkins | H05B 3/74 219/448.19 |
| 8,835,812 | B2 * | 9/2014 | Braden | F24C 7/06 219/406 |
| 2002/0121510 | A1 | 9/2002 | Petri et al. | |
| 2009/0230122 | A1 | 9/2009 | Kwag et al. | |
| 2016/0174299 | A1 * | 6/2016 | De Los Toyos Lopez | H05B 3/74 219/448.17 |

* cited by examiner

RADIANT ELECTRIC HEATER

This application claims priority from provisional patent application No. 62/431,401, filed Dec. 7, 2016. The entire content of this application is incorporated herein by reference.

BACKGROUND

Technical Field

This invention relates to a radiant electric heater, such as for use in cooking appliances beneath a cooking surface, such as of glass ceramic.

Background of Related Art

It is known to provide a radiant electric heater comprising a dish-like support, such as of metal, containing a base layer of thermal insulation material, such as a microporous thermal insulation material, At least one electric heating element is supported relative to the base layer. Such a heater is well known to be used in cooking appliances, particularly in contact with the underside of a cooking surface which is commonly of glass ceramic.

For safety and/or control purposes, it is well known to provide a temperature-responsive device in the heater. Such a temperature-responsive device is known to comprise an elongate, rod-like component which typically includes an outer tube of quartz, or of ceramic such as cordierite, and which extends partly across the heater and overlying the heating element. The elongate, rod-like component is known to be secured at one end at a peripheral region of the dish-like support, and suitably to a switch head which is secured externally to the edge of the dish-like support. The elongate, rod-like component is secured such that it is incapable of articulation at its end where it is secured and extends in cantilevered manner, without support, partly across the heater.

This arrangement for the temperature-responsive device suffers from a disadvantage in that cooking appliances incorporating the heater are often required to pass mechanical and/or vibration tests, to ensure that damage is unlikely to occur during transportation and operation of such cooking appliances, such as cooking hobs.

A typical requirement is for a cooking hob to pass a drop test in which the hob, packaged for transportation, is dropped onto a solid surface from a typical height of 0.5 to 0.6 meters. During such a drop test, large inertial forces are imposed on the free end of the elongate, rod-like component of the temperature-responsive device in the heater. Such forces can cause the free end of the elongate, rod-like component to be deflected by a considerable amount. As a result, the elongate, rod-like component may fracture, or its free end may strike the underside of the overlying glass-ceramic cooking surface and may cause the glass-ceramic material of the cooking surface to fracture.

Another test carried out by appliance approval authorities simulates a heavy pan being dropped onto a glass-ceramic cooking surface having a heater located in contact with its underside. The resulting shock loading can result in severe deflection of the free end of the elongate, rod-like component of the temperature-responsive device in the heater, with undesirable consequences similar to those previously described.

United Kingdom Patent Application GB2181896 describes a support for the free end of the elongate, rod-like component of a temperature-responsive device in a heater in which a supporting member is mounted at the end of the rod-like component and either supports the free end above an upper surface of the base layer of thermal insulation material, or between the upper surface of the base layer and a lower surface of the glass-ceramic cooking surface. Such arrangements either have the disadvantage that the supporting member is retained solely in the thermal insulation material, which is generally unreliable, or between the insulation material and the cooking surface and stresses the cooking surface, and potentially causing it to fracture when either a packaged cooking appliance including the heater is subjected to a drop test or when a heavy cooking pan is dropped onto the glass-ceramic cooking surface.

U.S. Pat. No. 5,489,764 describes a supporting member for the free end of an elongate, rod-like component of a temperature-responsive device in a heater against which the free end is biased. The supporting member can be in the form of a projecting portion of the insulation in the center of the area of the insulation, or a separate supporting member, against which the free end of the elongate, rod-like component is biased. The supporting member is supported against the base layer of thermal insulation material to inhibit movement of the free end of the rod-like component towards the base layer, this being the direction in which the free end is biased, and may additionally be supported against the underside of the dish-like support to inhibit movement of the free end of the rod-like component toward the underside of the glass-ceramic cooking surface. Forming the supporting member, especially from the insulation material, can be complex and unreliable, while maintaining the rod-like component under constant stress can result in early failure. It can also be difficult to form a bead in the supporting member beneath the dish-like support. Consequently, the configurations disclosed in U.S. Pat. No. 5,489,764 are undesirably complex and unreliable.

U.S. Pat. No. 6,483,084 describes a radiant heater including a supporting member for the free end of an elongate, rod-like component of a temperature-responsive device and which is said to improve fitting of the temperature-responsive device. The supporting member is shaped at least partly from the material of the dish-like support, with the free end of the elongate, rod-like component being supported by a bulge formed in the insulation material. It is therefore necessary to deform the base of the dish-like support in a complex manner, and to mold a thermal insulation material into the deformed dish while forming a bulge in the center of the insulation material.

United States Patent Application Publication No. 2002/0170906 describes a further radiant electric heater in which the free end of an elongate rod-like component of a temperature-responsive device is supported above thermal insulation material within a dish-like support. In this case, the supporting member allows limited movement of the free end of the elongate, rod-like component of the temperature-responsive device which allows a degree of flexibility when installing the temperature-responsive device, but restricts movement sufficiently to prevent damage when undergoing a drop test. The disadvantage of the arrangement described in US2002/0170906 is that the supporting member is retained in the thermal insulation material and can break loose in the event of a sudden impact.

SUMMARY OF THE INVENTION

The present invention provides a radiant electric heater having a supporting member which is more reliably mounted in the heater to resist sudden loads, while being simple and economical to manufacture and install.

According to one embodiment of the present invention there is provided a radiant electric heater comprising: a dish-like support having a base layer of thermal insulation material; at least one heating element supported relative to the base layer; a temperature-responsive device having a rod-like component secured at one end at a peripheral region of the dish-like support and extending without support partly across the heater over the at least one heating element; and a supporting member provided at a free end region of the rod-like component, wherein the supporting member comprises a central portion with a hoop at a first end to receive the free end of the rod-like component and a foot at a second end, the foot being bent at an angle relative to the central portion, and wherein a base of the dish-like support is provided with a loop of material extending internally of the dish-like support so as to provide an opening between the base of the dish-like support and the loop, the foot of the supporting member being received through the opening.

The supporting member may be made of corrosion-resistant sheet material, for example a metal such as stainless steel.

The foot may be bent at an angle of about 90 degrees to the central portion.

The foot may be substantially parallel to the base and the central portion and hoop may be substantially perpendicular to the base.

The loop may be pressed out of the base of the dish-like support.

The loop may have a substantially flat central region which is raised above the level of the base and connected to the base by a leg provided at each end of the central region. Where the loop is not integral with the base, the free ends of the legs of the loop may be secured to the base, for example by way of outwardly extending feet at the free end of each leg.

The base layer may comprise a microporous thermal insulation material. The base layer may be compacted into the dish-like support to a depth such that a part of the central leg portion and the hoop of the supporting member extend above the upper surface of the base layer.

The or each heating element may comprise a corrugated metal ribbon which is supported edgewise on the base layer by partially embedding the ribbon in the base layer.

A peripheral wall of thermal insulation material may extend around an inner periphery of the dish-like support and around an outer periphery of the heating element.

BRIEF DESCRIPTION OF THE DRAWINGS

For a better understanding of the present invention and to show more clearly how it may be carried into effect reference will now be made, by way of example, to the accompanying drawings in which.

DESCRIPTION OF PREFERRED EMBODIMENTS

Figure 1:
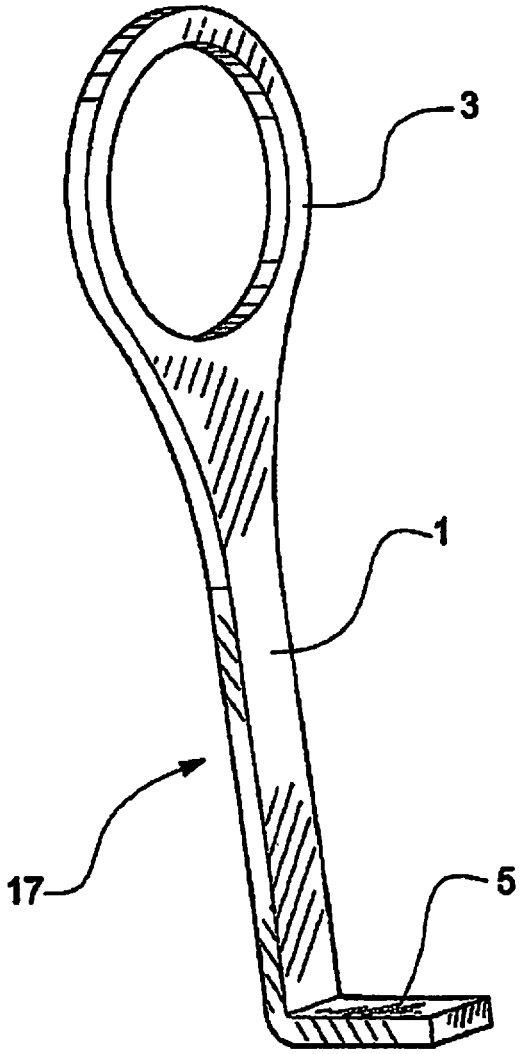
FIG. 1 shows one embodiment of a supporting member for use in a radiant heater according to the present invention.

The supporting member, or stem end restraint, shown in FIG. 1 is pressed from corrosion-resistant sheet material, for example a metal such as stainless steel, to prevent degradation in a high-temperature environment. The stem end restraint, designated generally by reference numeral 17, has a central leg portion 1 with a closed hoop 3 at one end to receive the free end of an elongate rod-like component, or stem, of a temperature-responsive device. The hoop is dimensioned to have a greater cross-sectional area than the stem in order to allow limited movement of the stem relative to the hoop, but to limit the amount of movement to prevent breakage of the stem or other components of a radiant heater when subjected to a drop test or other sudden impact. The hoop 3 is shown as being substantially circular, but may have other shapes. For example, the hoop may be oval, with the longer axis either parallel to or perpendicular to the elongate direction of the central leg portion, or alternatively, the hoop may be generally rectangular. A foot 5 is formed at the end of the central leg portion opposite to the hoop 3 and is bent at an angle to the central portion, preferably at an angle of about 90 degrees, although other angles are also contemplated.

Figure 2:
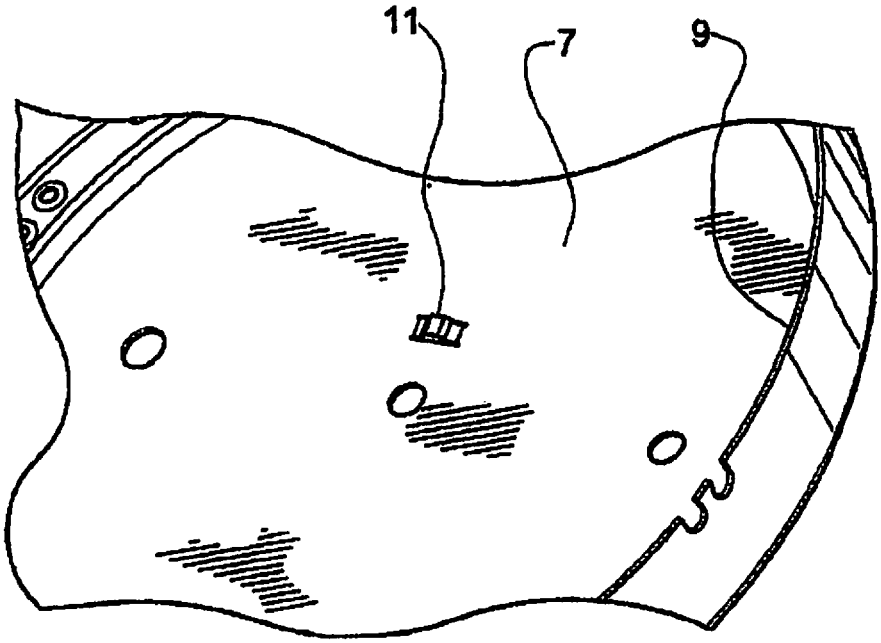
FIG. 2 is a partial view from above of one embodiment of a metal dish for use with the supporting member shown in FIG. 1.

FIG. 2 shows part of a metal dish for use with the supporting member shown in FIG. 1. The metal dish is made, for example, of zinc-plated steel and has a generally flat base 7 and an upstanding peripheral wall 9. Metal dishes of this type are commonplace in radiant electric heaters for domestic cookers. In this case, however, the base 7 of the metal dish is formed with a loop 11 which is pressed out of the base material and which extends internally of the dish so as to provide an opening between the base of the dish and the loop. The loop has a substantially flat central region which is raised above the level of the base, and connected to the base, by a leg provided at each end of the central region. The legs are of a length to raise the central portion of the loop sufficiently above the level of the base to allow the foot 5 of the supporting member to pass between the central portion of the loop and the base. In the illustrated embodiment, loop 11 is pressed out of the base 7 of the metal dish, however, other constructions are also possible. For example, the free ends of the legs of the loop may be secured, e.g., by welding, to the base. In one embodiment, the loop may be a separate component formed with outwardly extending feet at the free end of each leg, the feet being welded, for example spot welded, to the base. In such an embodiment, no opening is formed in the base in the region of the loop.

Figure 3:
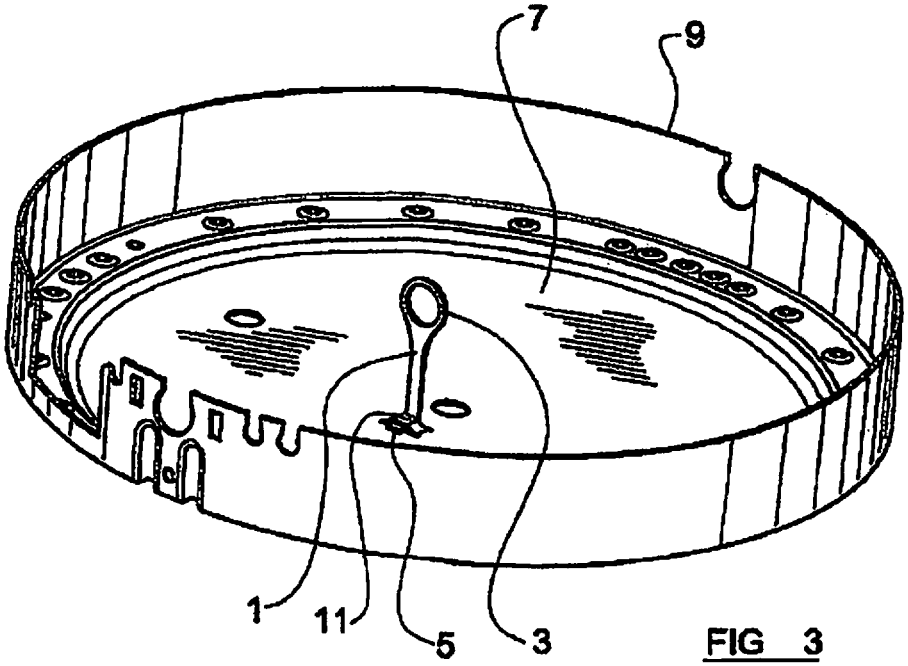
FIG. 3 is a partial view from above of the metal dish of FIG. 2 with the supporting member of FIG. 1 positioned therein.
Figure 4:
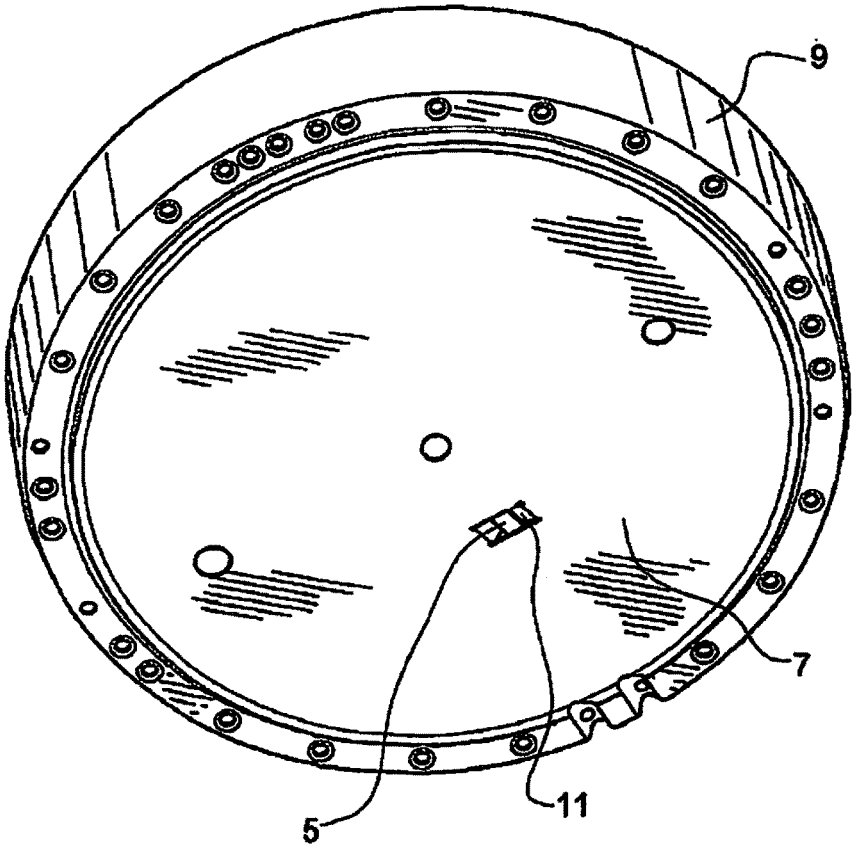
FIG. 4 is partial a view from below of the metal dish and supporting member combination shown in FIG. 3.

FIGS. 3 and 4 show the supporting member of FIG. 1 positioned in the metal dish of FIG. 2 and extending therefrom. As can be seen from FIGS. 3 and 4, the foot 5 of the supporting member extends through the opening between the base of the dish and the loop 11, that is to say between the central portion of the loop 11 and the base 7 of the metal dish, with the foot substantially parallel to the base and the central leg portion 1 and hoop 3 substantially perpendicular to the base. It is convenient from a manufacturing point of view if the central leg portion and hoop of the supporting member lie in a plane substantially perpendicular to the plane of the base, however, other angles are also contemplated.

Figure 5:
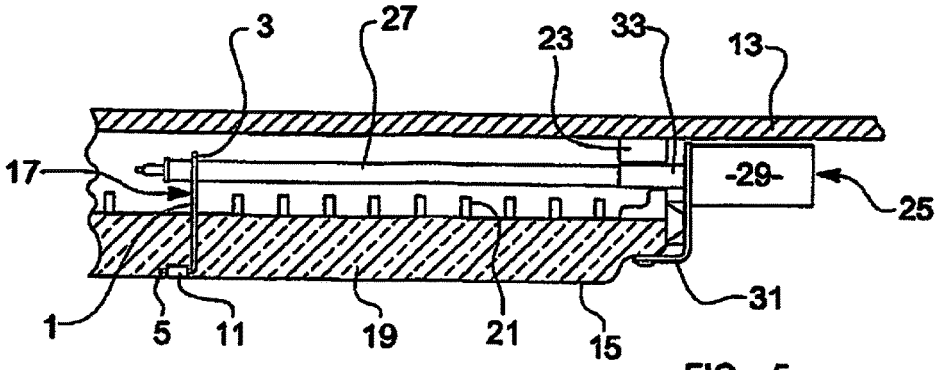
FIG. 5 is a partial cross-sectional view of one embodiment of a radiant electric heater according to the present invention and including a supporting member and a metal dish.

FIG. 5 shows one embodiment of a radiant electric heater according to the present invention including a supporting member such as that shown in FIG. 1 and a metal dish such as that shown in FIG. 2, the radiant electric heater being positioned beneath a cooking surface 13, for example of glass-ceramic material, of an electric cooker. The radiant electric heater shown in FIG. 5 comprises a metal dish 15 having a base 7 and a peripheral wall 9 (as in FIG. 2) and being formed with a loop 11 which receives the foot 5 of a supporting member 17, the supporting member also including central leg portion 1 and hoop 3 (as in FIG. 1).

The lower part of the metal dish contains a base layer 19 of thermal insulation material, such as microporous thermal insulation material, which is compacted into the metal dish to a depth such that a part of the central leg portion and the hoop of the supporting member 17 extend above the upper surface of the insulation material. At least one heating element 21 is supported in the metal dish relative to the base layer 19 so as to emit radiant energy towards and through the cooking surface. The heating element may take one or more well known forms of heating element, such as a corrugated metal ribbon, helical wire coil or an infra-red lamp. As illustrated, the heating element comprises a corrugated metal ribbon which is supported edgewise on the base layer by partially embedding the ribbon in the base layer. A peripheral wall 23 of thermal insulation material extends around the inner periphery of the metal dish 15 and around the outer periphery of the heating element 21. A temperature-responsive device 25, or temperature limiter, is provided for preventing overheating of the heater or the cooking surface 13. The temperature-responsive device is of known form and comprises a rod-like component (member) 27 secured at one end to a switch head arrangement 29. The switch head arrangement 29 is secured by a metal bracket 31 to the peripheral wall 9 of the metal dish. The rod-like component 27 comprises a metal expansion rod within a low-expansion tube, such as of quartz or a ceramic material such as cordierite. The rod-like component 27 is arranged to operate one or more switches in the switch head 29 in well known manner.

The rod-like component 27 is tightly fitted at one end inside a metal ferrule 33 which is secured to the bracket 31, for example by welding, and the rod-like component 27 extends without support or other force acting thereon, in cantilevered manner partly across the heater and overlying the heating element 21.

The free end of the rod-like component 27 passes through the hoop 3 of the supporting member 17 which limits displacement of the free end of the rod-like component in a direction towards and/or away from the surface of the base layer 19. When the free end of the rod-like member 27 is deflected as a result of a mechanical shock load, the rod-like member 27 encounters the hoop 3 which limits the displacement to prevent damage to the rod-like member, other components of the radiant heater, or the cooking surface 13. The supporting member 17 is securely mounted to the base 7 of the metal dish 15, and not in the base layer 19 of insulation material, in a manner which prevents the supporting member 17 breaking free from the metal dish and therefore prevents both upward and downward movement of the supporting member relative to the metal dish. This, in turn, reliably prevents the rod-like component 27 contacting other components of the radiant heater or the cooking surface, while being economical and efficient to implement because it requires minimal design modifications to the metal dish. The use of a supporting member that is separate to the metal dish, while still being linked to the dish, allows different materials to be used for the dish and the supporting member, for example allowing materials having a greater resistance to corrosion to be used for the supporting member which is exposed to significantly elevated temperatures within the heater.

While the above description contains many specifics, those specifics should not be construed as limitations on the scope of the disclosure, but merely as exemplifications of preferred embodiments thereof. Those skilled in the art will envision many other possible variations that are within the scope and spirit of the disclosure. Although the apparatus and methods of the subject invention have been described with respect to preferred embodiments, those skilled in the art will readily appreciate that changes and modifications may be made thereto without departing from the spirit and scope of the present invention as defined by the appended claims.

What is claimed is:

1. A radiant electric heater comprising: a dish-like support having a base layer of thermal insulation material; at least one heating element supported relative to the base layer; a temperature-responsive device having a rod-like component secured at one end at a peripheral region of the dish-like support and extending without support partly across the heater over the at least one heating element; and a supporting member provided at a free end region of the rod-like component, wherein the supporting member comprises a central portion with a hoop at a first end to receive the free end of the rod-like component and a foot at a second end, the foot being bent at an angle relative to the central portion, and wherein a base of the dish-like support is provided with a loop of material extending internally of the dish-like support so as to provide an opening between the base of the dish-like support and the loop, the foot of the supporting member being received through the opening, wherein the loop is pressed out of the base of the dish-like support, and wherein the loop has a region raised above the level of the base and connected to the base by a leg provided at each end, each leg being of a length to raise a central region of the loop sufficiently above a level of the base to allow the foot of the supporting member to pass between the central portion of the loop and the base, the loop forming an opening therethrough and the foot extending entirely through the opening.

2. The heater of claim 1, wherein the supporting member is made of corrosion- resistant sheet material.

3. The heater of claim 2, wherein the supporting member is made of metal.

4. The heater of claim 3, wherein the supporting member is made of stainless steel.

5. The heater of claim 1, wherein the foot is bent at an angle of 90 degrees to the central portion.

6. The heater of claim 5, wherein the foot is substantially parallel to the base and the central portion and hoop are substantially perpendicular to the base.

7. The heater of claim 1, wherein the loop has a substantially flat central region.

8. The heater of claim 7, wherein, where the loop is not integral with the base, and free ends of the legs of the loop are secured to the base.

9. The heater of claim 8, wherein the free ends of the loop are secured to the base by way of outwardly extending feet at the free end of each leg.

10. The heater of claim 1, wherein the base layer comprises a microporous thermal insulation material.

11. The heater of claim 1, wherein the base layer is compacted into the dish-like support to a depth such that a part of a central leg portion and the hoop of the supporting member extend above the upper surface of the base layer.

12. The heater of claim 1, wherein each heating element comprises a corrugated metal ribbon which is supported edgewise on the base layer by partially embedding the ribbon in the base layer.

13. The heater of claim 1, wherein a peripheral wall of thermal insulation material extends around an inner periphery of the dish-like support and around an outer periphery of the heating element.

14. A radiant electric heater comprising: a dish-like support having a base layer of thermal insulation material; at least one heating element supported relative to the base layer; a temperature-responsive device having a rod-like component secured at one end at a peripheral region of the dish-like support and extending without support partly across the heater over the at least one heating element; and a supporting member provided at a free end region of the rod-like component, wherein the supporting member comprises a central portion with a hoop at a first end to receive the free end of the rod-like component and a foot at a second end, the foot being bent at an angle relative to the central portion, and wherein a base of the dish-like support is provided with a loop of material extending internally of the dish-like support so as to provide an opening between the base of the dish-like support and the loop to receive the foot of the supporting member, wherein the insulation material has an upper surface closer to the rod like element, a lower surface further from the rod like element and a region in between the upper and lower surface through which the supporting member extends such that the supporting member is attached to the loop of the base adjacent the lower surface of the insulation material and the insulation material overlies and is in contact with the loop, wherein the supporting member is a separate component extending through the insulative material to the loop and the hoop is spaced from the insulating material.

15. The heater of claim 14, wherein the foot is substantially parallel to the base and the central portion and hoop are substantially perpendicular to the base.

16. The heater of claim 14, wherein the loop is pressed out of the base of the dish-like support.

17. The heater of claim 14, wherein the loop is not integral with the base, and free ends of the legs of the loop are secured to the base.

18. The heater of claim 17, wherein the free ends of the loop are secured to the base by way of outwardly extending feet at the free end of each leg.

19. A radiant electric heater comprising: a dish-like support having a base layer of thermal insulation material; at least one heating element supported relative to the base layer; a temperature-responsive device having a rod-like component secured at one end at a peripheral region of the dish-like support and extending without support partly across the heater over the at least one heating element; and a supporting member provided at a free end region of the rod-like component, wherein the supporting member comprises a central portion with a hoop at a first end to receive the free end of the rod-like component and a foot at a second end, the foot being bent at an angle relative to the central portion, and wherein a base of the dish-like support is provided with a loop of material extending internally of the dish-like support so as to provide an opening between the base of the dish-like support and the loop, the foot of the supporting member being received through the opening, wherein the insulation material has an upper surface closer to the rod like element, a lower surface further from the rod like element and a region in between the upper and lower surface through which the supporting member extends such that the supporting member is attached to the loop of the base adjacent the lower surface of the insulation material and the insulation material overlies the loop, and the upper surface extends below the heating element.

* * * * *